United States Patent [19]

Frantz

[11] 4,367,003

[45] Jan. 4, 1983

[54] CONNECTOR LATCHING MECHANISM

[75] Inventor: Robert H. Frantz, Carlisle, Pa.

[73] Assignee: AMP Incorporated, Harrisburg, Pa.

[21] Appl. No.: 187,103

[22] Filed: Sep. 15, 1980

[51] Int. Cl.[3] ..... H01R 13/629

[52] U.S. Cl. ..... 339/91 R; 292/161; 403/406

[58] Field of Search ..... 339/75 R, 75 M, 91 R; 24/211 L; 403/398, 399, 406; 292/161

[56] References Cited

U.S. PATENT DOCUMENTS

| | | | |
|---|---|---|---|
| 1,438,547 | 12/1922 | O'Connor | 292/161 |
| 3,101,229 | 8/1963 | Yopp | 339/59 |
| 3,566,336 | 2/1971 | Johnson et al. | 339/91 |
| 3,879,099 | 4/1975 | Shaffer | 339/99 R |
| 3,904,265 | 9/1975 | Hollyday et al. | 339/103 M |
| 4,062,616 | 12/1977 | Shaffer et al. | 339/99 R |
| 4,067,633 | 1/1978 | Groft et al. | 339/74 R |
| 4,178,051 | 12/1979 | Kocher et al. | 339/45 M |

FOREIGN PATENT DOCUMENTS

| | | | |
|---|---|---|---|
| 999861 | 2/1952 | France | 339/75 M |
| 453456 | 6/1968 | Switzerland | 339/75 R |

*Primary Examiner*—John McQuade

*Attorney, Agent, or Firm*—Russell J. Egan

[57] ABSTRACT

A latching mechanism is disclosed for use with almost any known electrical connector. The subject latching mechanism is operable by one hand from one end of the connector. Thus, the subject latching mechanism is suitable for use in high density arrays of connectors where there is access to only one end portion of the connector and yet latching on both ends is required.

11 Claims, 4 Drawing Figures

CONNECTOR LATCHING MECHANISM

BACKGROUND OF THE INVENTION

1. The Field Of The Invention

The present invention relates to a latching mechanism for electrical connectors and in particular to a mechanism which can be operated by one hand from one end of the connector.

2. The Prior Art

There are many well known latching systems for electrical connectors. Some of these require two hand operation while others, such as the one described in U.S. Pat. No. 4,178,051, can be operated by one hand only. While the device described in this patent can be operated by one hand, it requires grasping the connector at opposite ends to effect the latching release. Other connectors have a similar requirement for grasping opposite sides, such as the connector shown in U.S. Pat. No. 4,067,633 in which the sides of the connector are squeezed to effect release. While these mechanisms are completely satisfactory in operation, they are not suitable for use in high density arrays of plugs where it is only possible to gain access to one end portion of a connector.

SUMMARY OF THE INVENTION

The present invention pertains to a latching device for locking together mated connector members. The latching device is operable with one hand from one end of the connector and is formed by a pivotably mounted actuating member and a slidable latching member. Each of the connector members has a latching stud secured to each end thereof and the studs come into an abutting relationship when the members are mated. The latching member is slidable with respect to the mated members to engage all four studs thereby securing the connectors together. The actuating member causes the relative sliding movement of the latching member.

It is therefore an object of the present invention to produce an improved latching system for electrical connectors which system can be operated by one hand at one end of the connector.

It is another object of the present invention to produce an improved connector latching system which can be readily added onto known connectors.

It is still another object of the present invention to produce a latching system which can be operated from one end only of a connector member thereby making it suitable for use in high density arrays.

It is a further object of the present invention to produce a latching system which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
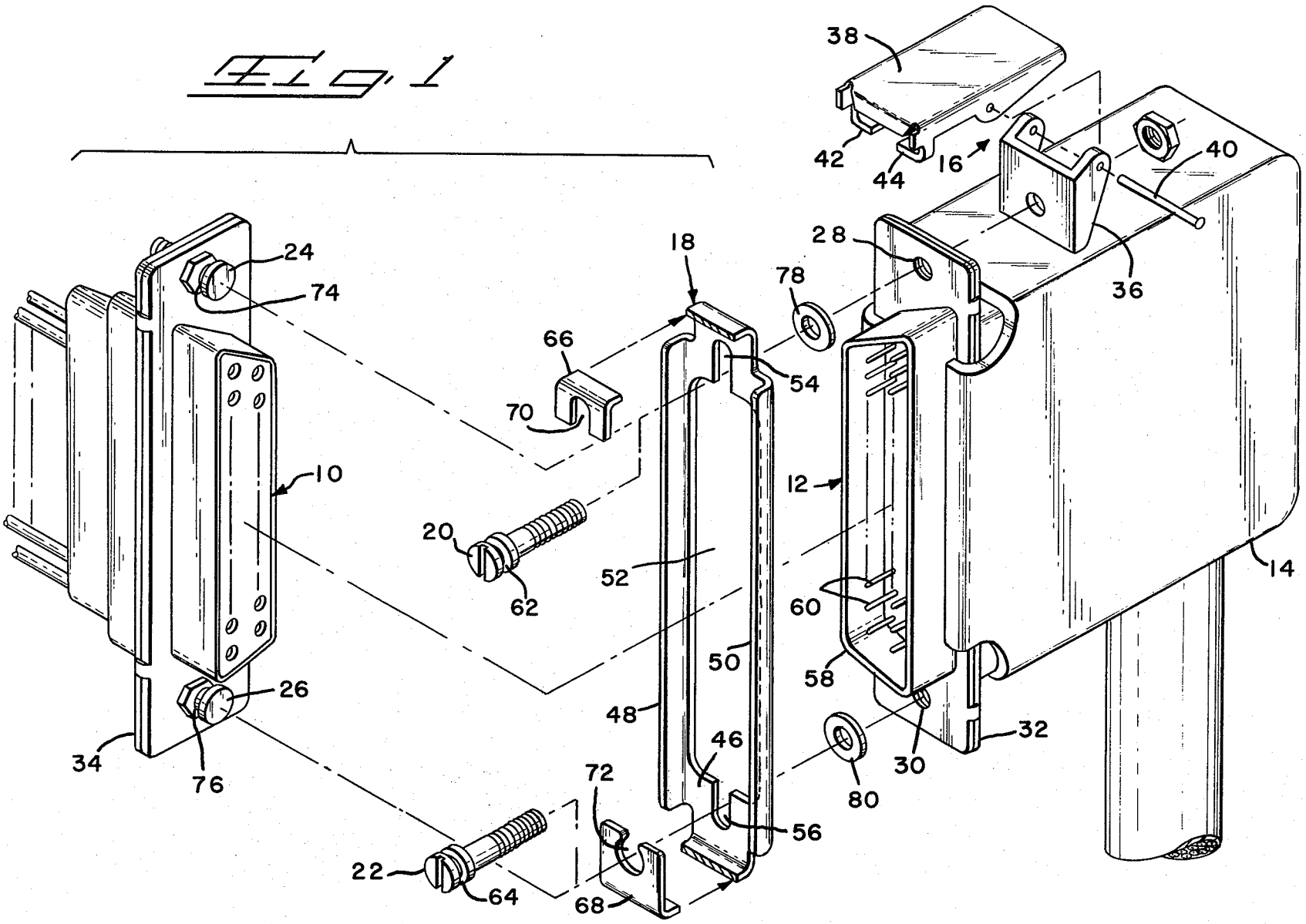
FIG. 1 is an exploded perspective view of the subject latching system together with matable connector members.
Figure 2:
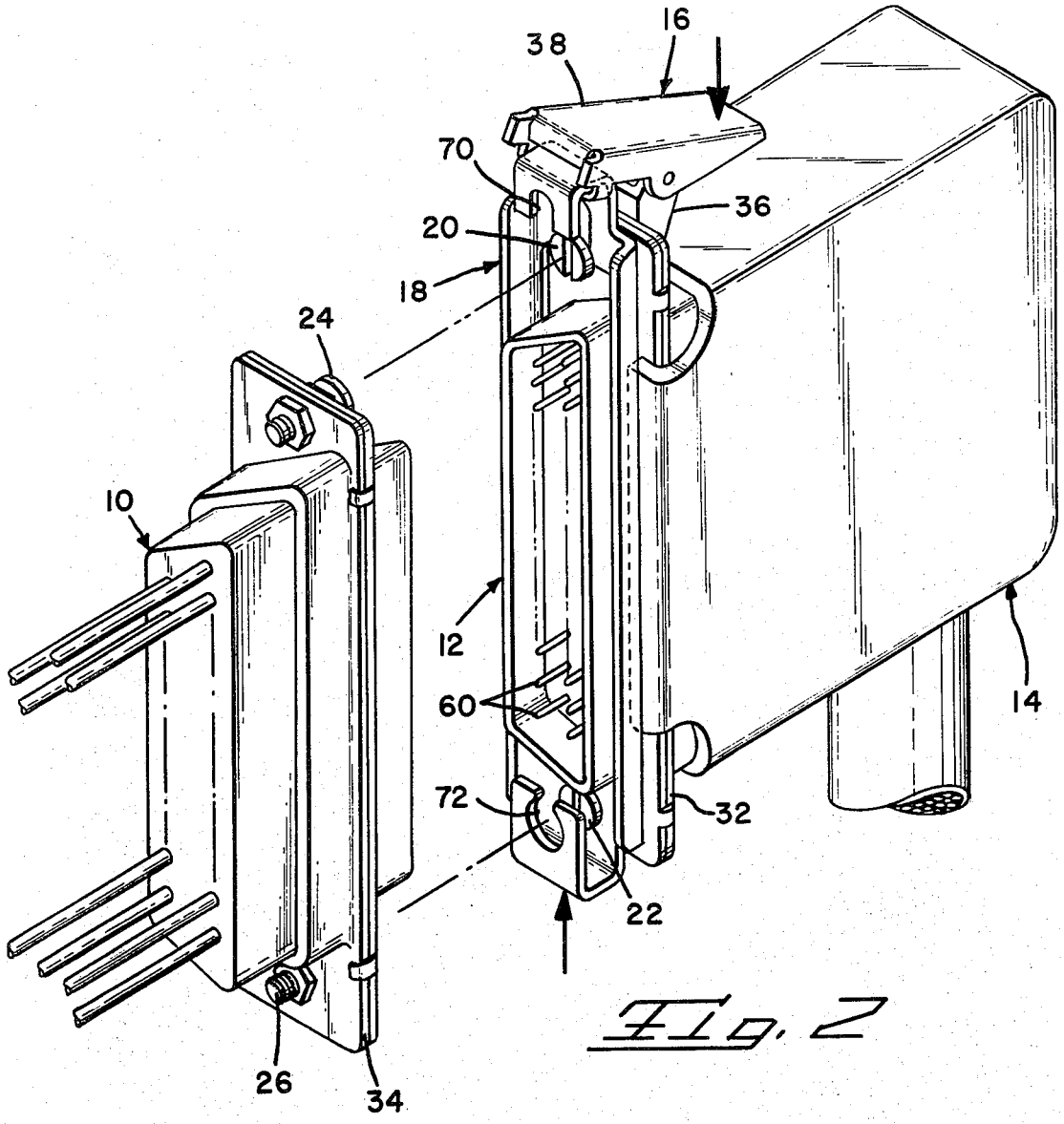
FIG. 2 is a perspective view of the subject invention in a fully assembled but unmated condition.

The subject latching system has been shown in FIGS. 1 and 2 with a connector of known type as shown for example in U.S. Pat. Nos. 3,101,229 or 3,879,099 or 4,062,616, the disclosures of which are incorporated herein by reference. The connector comprises a receptacle member 10 and a plug member 12. The plug member 12 has attached thereto a cable strain relief 14 which can be of the type shown in U.S. Pat. No. 3,904,265, the disclosure of which is also incorporated herein by reference.

The subject latching system includes an actuating assembly 16, a latching member 18, a pair of first abutment studs 20, 22, and a pair of second abutment studs 24, 26. The first abutment studs 20, 22 are secured in apertures 28, 30 in opposite ends of a peripheral flange 32 on the plug member 12 while the second studs 24, 26 are mounted in a similar fashion in flange 34 of the receptacle member 10. It should be noted that the receptacle member would most likely be panel mounted so that the second studs would also be used to mount the receptacle member in a panel (not shown). The actuating assembly 16 is secured at one end of the flange 32 on plug member 12 by the first stud 20. The actuating assembly 16 includes a pivot member 36 having an actuating lever 38 attached thereto by means of pivot pin 40. The lever 38 has a pair of inwardly directed arms 42, 44 at one end thereof. The latching member 18 is an elongated rigid member having a generally channel shaped section formed by base 46 and integral spaced side walls 48, 50 and provided in its base with a profiled opening 52 including slots 54, 56 at opposite ends thereof. Due to the large size of opening 52, it is clear that sidewalls 48, 50 provide the necessary rigidity and strength for member 18. The opening 52 has a profile generally similar to the hood 58 surrounding the pin terminals 60 of the plug member 12 but long enough to allow relative lateral motion. The slots 54, 56 are of sufficient length to engage and slide in the annular grooves 62, 64 of the mounting studs 20, 22 respectively. At each end of the member 18 there is an overturned extension 66, 68 each with a respective slot 70, 72 with the slots 70, 72 overlying slots 54, 56, respectively in a parallel spaced relationship. The slots 70, 72 are spaced so as to engage in the annular grooves 74, 76 in the second abutment studs 24, 26, respectively. It should be noted that the slot 70 is a substantially straight slot while the slot 72 has a generally keyhole configuration of a narrow open neck extending into an enlarged generally circular opening.

It should be noted that the first and second abutment studs have been shown with two different configurations. They, of course, could be identical and could have a variety of configurations. The only requirement for these members is to have mounting means, abutment faces, and annular slots spaced from the abutment faces.

The subject latching system is assembled as shown in FIG. 2 with the first abutment studs 20, 22 passing through the respective slots 54, 56 and spacer washers 78, 80 into the apertures 28, 30 of the plug. The pivot plate 36 is secured to the stud 20 and the arms 42, 44 of the lever 38 engage under opposite sides of the extension 66 of latching member 18.

Figure 3:
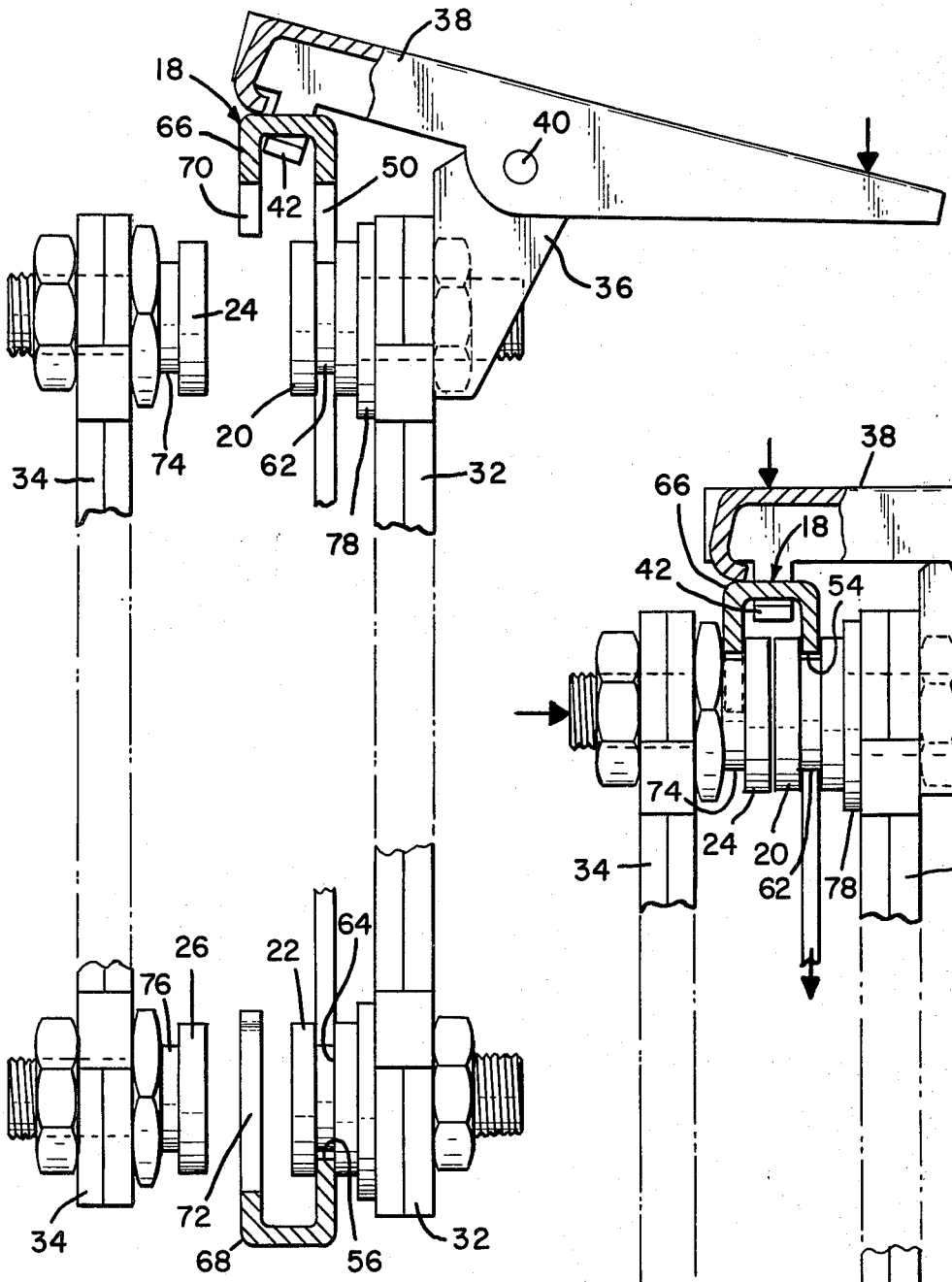
FIG. 3 is a side elevation, partly in section, of the subject latching system in an unmated and unlatched condition.
Figure 4:
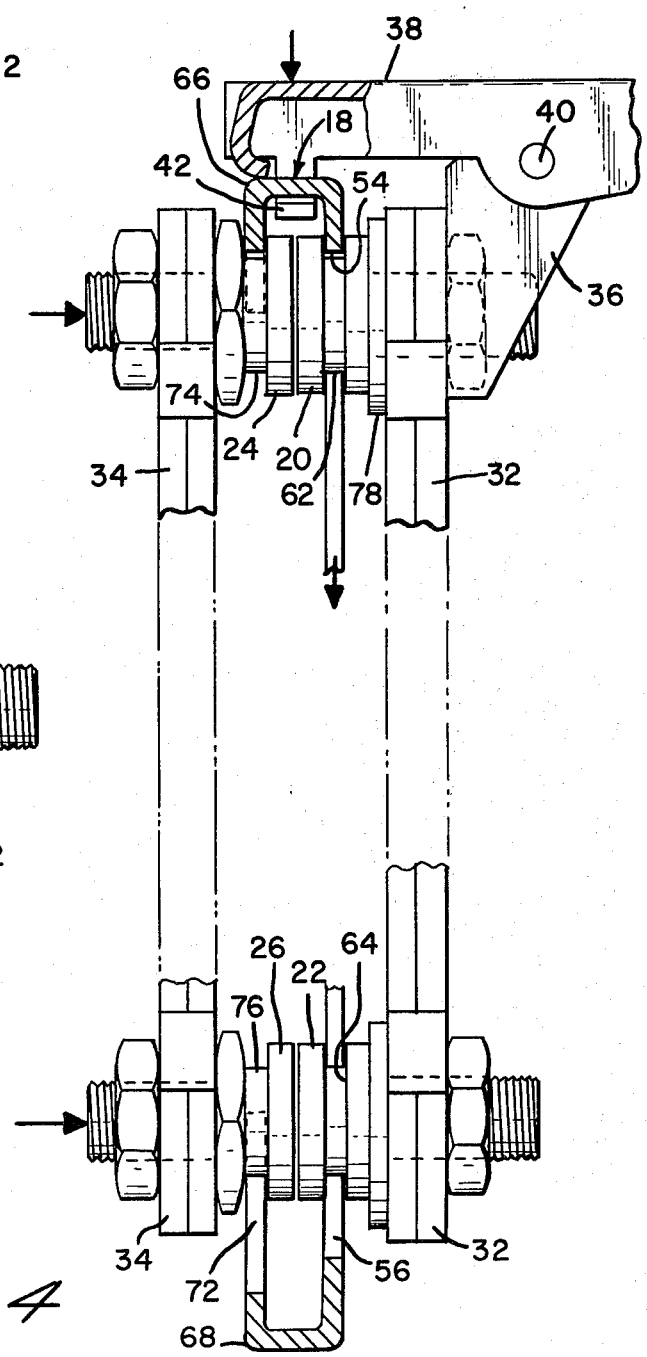
FIG. 4 is a side elevation, partly in section, of the subject latching system in a mated and latched condition.

The operation of the subject latching system will be readily understood from FIGS. 3 and 4 which show that when the lever 38 is rotated in a clockwise direction, as shown by the arrow indicating pressure on the tail of the lever, the sliding latching member 18 will be drawn to its uppermost position (FIG. 3). In this position the abutment studs 20, 22 engage the edges of respective slots 54, 56 by grooves 62, 64 to hold the latch member 18 in assembly with the plug member 12. It will also be noted that in this position the extension 66 is moved so that slot 70 is clear of the second abutment stud 24 while the enlarged portion of slot 72 is aligned with the second abutment stud 26 to receive the stud therethrough. Mating of the connector members 10 and 12 brings the first and second stud members into an abutting relationship, as shown in FIG. 4. Rotation of the lever in a counterclockwise direction, as shown by the arrow in FIG. 4, drives the latching member 18 downwardly so that the slots 70, 72 engage in the respective annular grooves 74, 76 of the second abutment stud members thereby securing the connector members together.

It will be appreciated from the foregoing that the simple rocking motion of the lever 38 is all that is necessary to effect the locking and unlocking engagement of the connector. It will also be appreciated that it is not necessary to use two hands for this operation or even to grasp both ends of the connector with one hand.

The present invention may be subject to many modifications and changes without departing from the spirit or essential characteristics thereof. The present embodiment should therefore be considered in all respects as merely illustrative and not restrictive of the scope of the invention.

What is claimed is:

1. A latching system for securing a pair of mating electrical connector members together in a mated condition and operable by one hand acting on only one end of the connector members, said latching system comprising:

at least two first abutment members mounted in spaced relationship on one of said pair of connector members;

at least two second abutment members, each mounted on the other connector member and aligned to abut a respective first abutment member;

an elongated latching member defining a profiled opening similar to but longer than mating portions of said connector members, oppositely directed first slots at each end of said profiled opening, an extension at each end of said latching member overlying each said first slot, a second slot formed in each said overlying portion parallel to and spaced from the first slot, said latching member being mounted on one of said connector members with said first abutment members engaging in said first slots and said mating portion of said connector member being exposed in said opening;

actuating means mounted on one end of said one connector member and connected to drive said latching member transversely with respect to the mating portion of said connector member;

whereby upon mating of said connector members and actuation of said latching member said second abutment members are engaged by said second slots to secure said connector members together in a mated condition.

2. A latching system according to claim 1 wherein:

each said first and said second abutment members are elongated members having mounting means on one end, an abutting surface on the opposite end, and an annular groove therein spaced from said abutting surface.

3. A latching system according to claim 1 wherein said actuating means comprises:

a pivot member secured to said one end of said one connector member; and a lever pivotally mounted on said pivot member with one end connected to said latching member.

4. A latching assembly for detachably securing connector members together in a mated condition, said assembly comprising:

at least two first abutment members secured to a first connector member in spaced relationship;

at least two second abutment members secured to a second mating connector member in spaced relationship aligned to abut said first abutment members;

a latching member mounted on one of said connector members for transverse motion with respect thereto, said latching member permanently engaging said abutment members of said one connector member and selectively engaging the said abutment members of said other connector member; and an actuating means mounted on said one connector member and connected to move said latching member transversely with respect to the connector members whereby said second abutment members are selectively engaged and disengaged.

5. A latching assembly according to claim 4 wherein each said first and said second abutment member comprises:

an elongated member having mounting means on one end, an abutment surface on the opposite end, and a profile intermediate said ends engagable by said latching member.

6. A latching assembly according to claim 5 wherein said mounting means comprise a threaded nut.

7. A latching assembly according to claim 4 wherein said latching member comprises:

an elongated rigid member having a profiled opening encircling the mating face of said one connector member, and opposed spaced slotted portions at each end of said rigid member engagable with said first and said second abutment members.

8. A latching mechanism for securing a pair of electrical connector members together in a mated condition and operable by one hand acting on only one end of the connector, said system comprising:

at least two spaced abutment members on each of said connector members each aligned to abut with a respective abutment member on the mating connector member;

an elongated latching member having a profiled opening with oppositely directed first slots at each end of said opening, an extension at each end of said member overlying each said first slot and with a second slot formed in each said overlying portion parallel to and spaced from the respective first slot, said latching member being mounted on one of said connector members with said abutment members of said one connector member engaging in said first slots providing guided relative movement of said latching member with respect to said one connector member, a mating face of said connector member being accessible through said opening; and an actuating lever pivotally mounted on one end of said one connector member and connected to drive said latching member transversely with respect to the mating face thereof with said abutment members of the mating connector member being received in and engaged by said second slots whereby said connector members are secured together.

9. A latching mechanism according to claim 8 wherein at least one of said second slots has a keyhole shaped profile whereby said abutment member is received through the enlarged portion and engaged by the narrow neck.

10. A latching mechanism according to claim 8 wherein said first slots are so dimensioned as to allow limited relative movement of said latching member without disengagement from said abutment members of said one connector member.

11. A latching mechanism according to claim 8 wherein each said abutment member comprises:

an elongated member having mounting means on one end, an abutment surface on the opposite end and a profiled intermediate portion engagable by said latching member.

* * * * *